US006005174A

United States Patent [19]

Regen

[11] Patent Number: 6,005,174

[45] Date of Patent: Dec. 21, 1999

[54] SLIDE-GUITAR CAPO

[76] Inventor: David M Regen, 4342 Sneed Ave., Nashville, Tenn. 37215

[21] Appl. No.: 08/941,987

[22] Filed: Oct. 1, 1997

[51] Int. Cl.[6] ..... G10D 3/00

[52] U.S. Cl. ..... 84/318

[58] Field of Search ..... 84/318

[56] References Cited

U.S. PATENT DOCUMENTS

| | | | |
|---|---|---|---|
| D. 324,532 | 3/1992 | Pearse | 84/318 X |
| 620,560 | 3/1899 | Averitt | 84/318 X |
| 1,788,636 | 1/1931 | Russell | 84/318 |
| 3,933,077 | 1/1976 | Dunlop | 84/318 |
| 4,250,790 | 2/1981 | Shubb | 84/318 |
| 4,304,165 | 12/1981 | Gould | 84/318 |
| 4,563,934 | 1/1986 | Keizer | 84/318 X |
| 4,621,558 | 11/1986 | Cornette | 84/318 |
| 4,671,156 | 6/1987 | Hathcock | 84/318 |
| 5,284,077 | 2/1994 | Ellis | 84/318 |

*Primary Examiner*—Jeffrey Donels

[57] ABSTRACT

A capo may be used on a guitar or banjo to reduce the operating length of all strings temporarily. The strings of a slide guitar (e.g. Dobro) are suspended approximately 1 cm above its fretboard and so cannot be clamped against a fret by a padded bar as with a Spanish guitar or banjo. In a typical embodiment, the slide-guitar capo is an essentially prismatic bar approximately 7–8 cm long, and made of metal or plastic. The three side faces of the prismatic bar are approximately 15.2, 13.7 and 12 mm wide; so that it has three ridge heights, approximately 10.2, 11.4 and 13 mm (were its edges not rounded) depending on which face is selected as base. A rectangular groove, 3.5 mm wide and 1.2 mm deep, runs the length of each side face of the bar, positioned below the bar's ridge when that face is the base. The side edges of the bar are rounded down approximately 0.2 mm. The end edges and corners are rounded down further, enough so that the bar slips easily between the guitar's fretboard and strings with a groove over a fret, the bar's ridge height being selected (approximately 10.0, 11.2 or 12.8 mm) to force the strings up enough to avoid buzzing of the strings when plucked with normal force. The groove's width exceeds a fret's width and is positioned such that the bar may be slipped toward the nut enough to achieve satisfactory tuning despite the additional string tension.

2 Claims, 4 Drawing Sheets

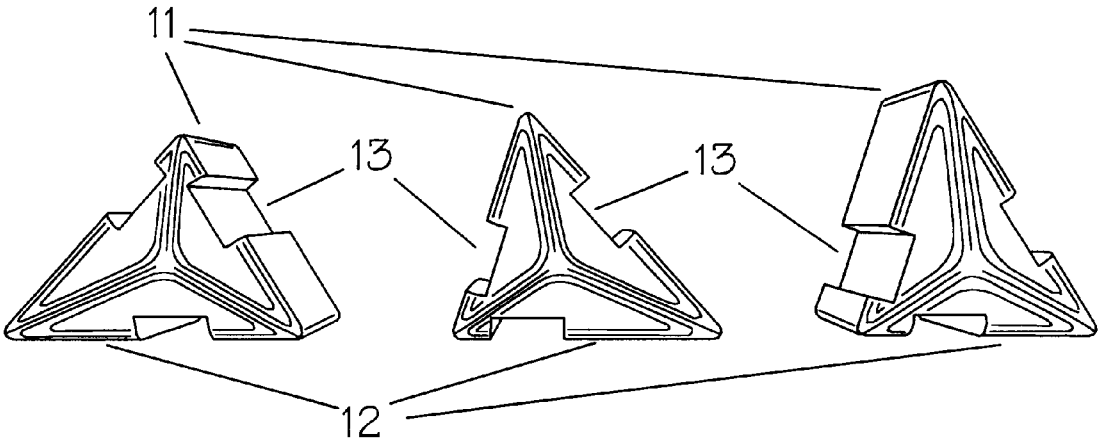
Fig 1A,B,C. Essentially end views of slide-guitar capo in three orientations.

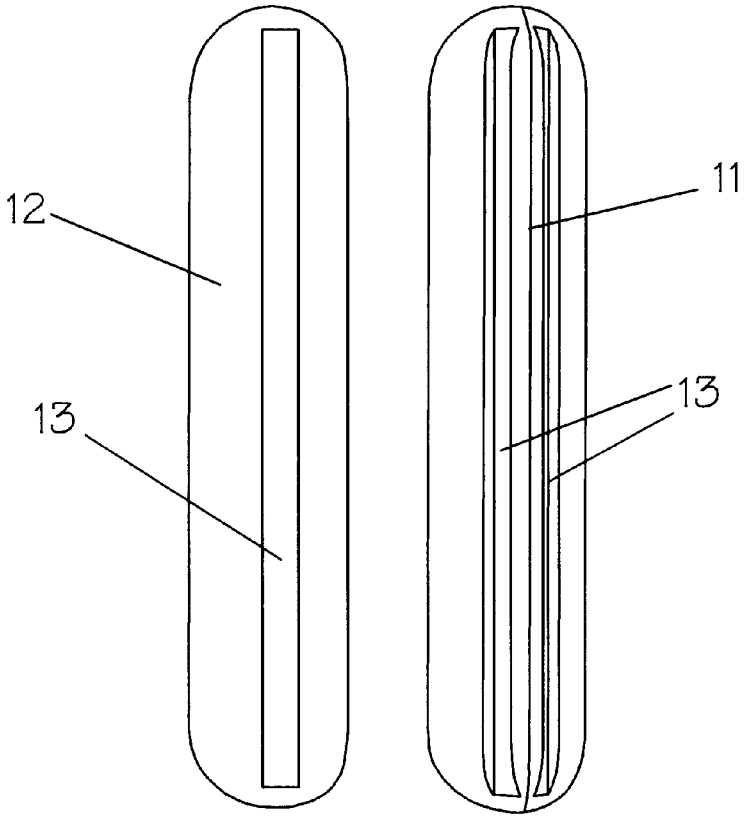
Fig 2A,B. Bottom and top outline views of slide-guitar capo with widest face as base.

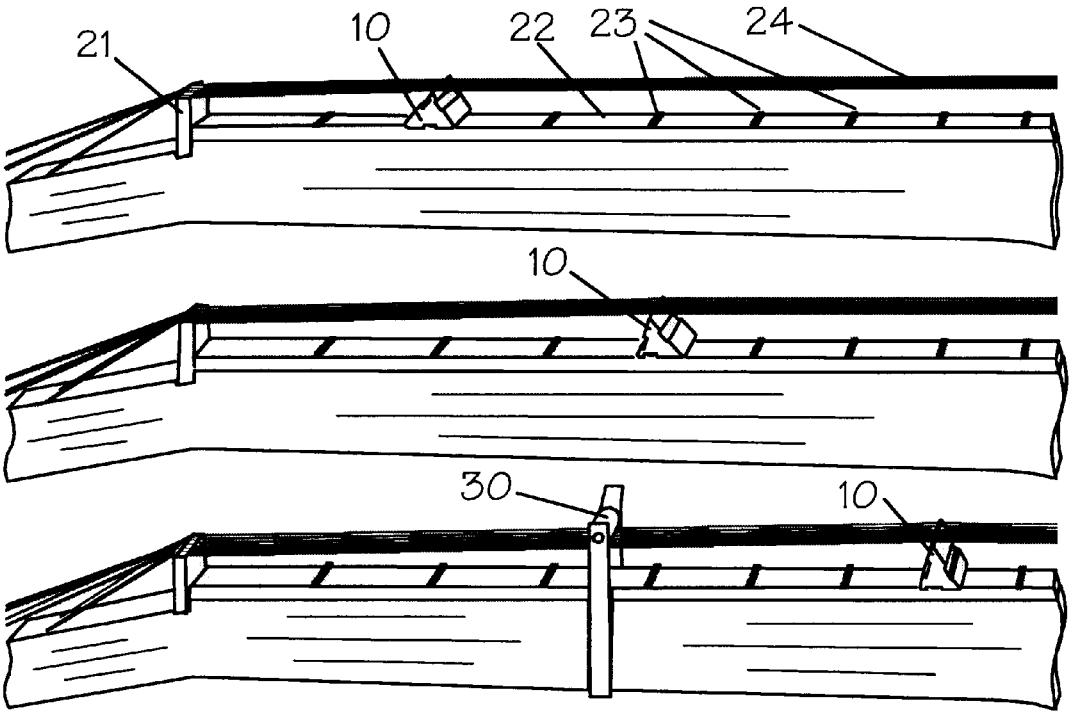
Fig 3A,B,C. Essentially side views of slide-guitar neck with capo at three fret positions in three orientations.

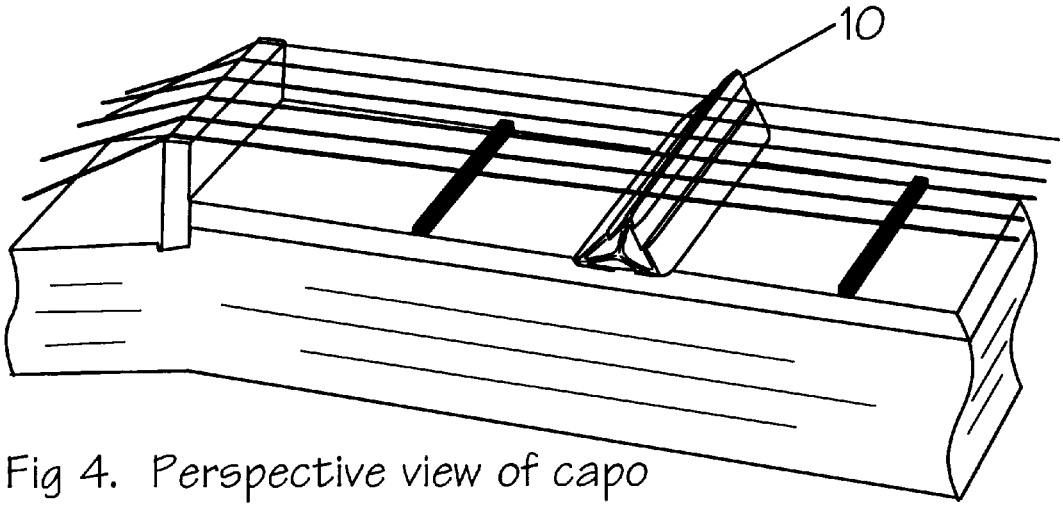
Fig 4. Perspective view of capo at 2nd fret of slide-guitar.

SLIDE-GUITAR CAPO

BACKGROUND OF THE INVENTION

1. Field of the Invention

This invention relates to a musical instrument, the slide guitar, specifically the means by which one may temporarily reduce the operating length of the guitar's strings so that the instrument can be played in a higher key by strategies similar to those used in a lower key in absence of said means.

2. Description of the Related Art

The main areas of a stringed musical instrument characterized by guitars, banjos and mandolins are the body, the neck and the head. The surface of the neck facing the strings is covered by a fretboard on which frets (narrow transverse elevations) are attached. The strings are positioned over the fretboard and frets by a bridge on the body and a nut at the head end of the fretboard. A capo is a device to reduce temporarily the operating length of the strings of such a musical instrument, so that the instrument can be played in a higher key by strategies similar to those used in a lower key in absence of a capo. For instruments, whose strings are pressed by the musician's fingers against frets during performance, a capo acts by clamping the strings against a fret (Averitt U.S. Pat. No. 620,560; Russell U.S. Pat. No. 1,788,636; Gould U.S. Pat. No. 4,304,165; Shubb U.S. Pat. No. 4,250,790; Cornette U.S. Pat. No. 4,621,558). The strings of a slide guitar (e.g. Dobro) are about 1 cm above the fretboard, so their operating length cannot be reduced practically by their being clamped against a fret.

Few slide-guitar capos have been patented or produced commercially. All of them involve at least: 1) a hard-surfaced bar approximately 6 cm long, to be positioned perpendicular to and across all the strings, either above the strings or between the strings and the fretboard; 2) a second bar (usually padded) of similar length to be positioned parallel to the first bar and on the other side of the strings from the first bar; and 3) a means whereby one bar presses the strings against the other bar, so that strings vibrate from their zone of contact with a hard edge of the first bar (the stop zone), rather than from the guitar's nut. This design has several desirable results. 1) The strings are thoroughly stopped at the stop zone to achieve durable ring and minimal buzz. 2) The strings are well damped behind the stop zone to avoid vibrations of the non-playing string segments between that zone and the guitar's nut. 3) Application of the capo produces only modest additional tension in the strings, so their pitches are only slightly above those expected from the location of the stop zone. 4) In the more thoughtful designs (which apparently exclude that of Dunlop U.S. Pat. No. 3,933,077), the capo can be placed at a position with the stop zone over the back edge of a fret or close by to achieve adequate tuning despite the effect of string tightening to raise pitch.

Most slide-guitar capos suffer from a major flaw. In those cases where a thick bar is above the strings and coincident with or near the stop zone (Hathcock U.S. Pat. No. 4,671,156; commercial make Leno; Dunlop U.S. Pat. No. 3,933,077; apparently unpatented design of Gene Wooten of Nashville, Tenn.), the capo interferes intolerably with the musician's operation of the slide bar at those frets near the capo. In the case where a thin bar is above the strings near the stop zone (Shubb U.S. Pat. No. 4,250,790, apparently a patent for the clamping mechanism; commercial make Shubb C6B), this problem is less severe but sill significant. The slide-guitar capo recently patented by Ellis (U.S. Pat. No. 5,284,077) solves this problem completely and will function well under most circumstances.

An unpatented and non-commercial slide-guitar capo consists of a hard, flat stick of dimensions between those of a tongue depressor and those of an ice-cream stick. This hard, flat stick is slipped between the fretboard and strings in the horizontal orientation and then rotated to the vertical orientation so as to press up on all strings at a zone just behind (on the nut side of) a fret. The advantage of this simple device by comparison to those just described is that their are no obstructions to impair the musician's operation of the slide bar at frets near the capo. It has several disadvantages. 1) The downward force of the strings is transmitted to and borne by a small area of fretboard, so their is a risk of scarring the fretboard, especially if the capo were of metal. 2) One would need at least three capos of this kind with differing widths, a greater width (dimension from fretboard to strings) being needed to stop the strings at higher fret positions, where the strings are further from the fretboard and require greater upward displacement to exert a given force against the capo. 3) The capo is not well stabilized between fretboard and strings, so it may move or collapse during performance. 4) Application of the capo adds significantly to string tension. 5) The non-playing segments of strings (between capo and nut) may not be adequately damped. 6) Ring duration may be shortened to an undesirable degree. 7) Buzzing may be difficult to avoid.

BRIEF SUMMARY OF THE INVENTION

There was a need for a capo which would reliably shorten the operating length of a slide guitar's strings with no component above the strings within inches of the stop zone. A capo was designed which would function like the flat-stick capo, in that it would rest on the fretboard and press up on the strings along a narrow zone above a fret or a zone slightly on the nut side of it. So that the capo would not move or collapse during performance, it was formed essentially as a triangular prism of length (distance between parallel end faces) somewhat greater than a fretboard's width and of ridge height (distance from one side face to the intersection of the other two side faces) slightly greater than the distance from the fretboard to the strings. This triangular prism of solid material will be referred to as a prismatic bar. Each side face of the prismatic bar has a different width, so the prismatic bar has three different ridge heights depending on which side is selected as base. This is valuable because the distance between fretboard and strings increases with distance from the nut and varies among different slide guitars. Each side face is longitudinally excavated to form a groove running the length of that face, each groove having a depth somewhat greater than a fret's height and a width somewhat greater than a fret's width and being positioned such that each ridge could be placed directly above one edge of a fret or slightly to either side of that edge (toward or away from the nut) when the groove below that ridge straddles a fret. The prismatic bar is more massive than the flat stick, resulting in more durable ring (the vibration of a string after it is plucked), if the two devices were of the same material. Downward force of the strings is transmitted to the fretboard via the bar's base, whose area is much greater than that of the edge of the flat stick, so there is less risk of scarring the fretboard. Other design features include rounded-down edges and rounded-down comers to avoid damage to strings, capo and fretboard, and to facilitate sliding of the capo over a fret and under the strings during application. Experience shows that buzzing of the strings and vibration of the non-playing string segments are not significant when the capo is at one of the three or four frets nearest the nut. At frets further from the nut, these undesirable events occur only with more vigorous string plucking and are not intolerable. They can be avoided completely by use of an accessory consisting of a thin padded bar positioned over the strings several inches toward the nut from the capo, said padded bar being equipped with a means to press the bar gently down on the strings. This combination has all the advantages of the patented and/or commercial dobro capos and all of the advantages of the flat-stick capo. It lacks the disadvantages of both. Most important, it provides a reliable capo action with nothing to interfere with operation of the slide bar near the capo.

BRIEF DESCRIPTION OF THE SEVERAL VIEWS OF THE DRAWINGS

The Figures

FIGS. 1 A, B and C show essentially end views of the slide-guitar capo in its three orientations.

FIG. 2A shows a bottom view of the capo when the widest of the three faces is down.

FIG. 2B shows a view from above (ridge-on view) when the widest face is down.

FIGS.3A, B and C show essentially side views of a slide-guitar neck with the capo in an appropriate orientation at each of three fret positions, FIG. 3C showing also an accessory device to press gently down on the strings inches toward the nut from the capo.

FIG. 4 shows a 3D view of the guitar neck with the capo at the second fret, the most common position.

| Reference Numerals in Figures | | |
|---|---|---|
| 10. Capo | 21. Nut | 30. Accessory device |
| 11. Ridge | 22. Fretboard | |
| 12. Base | 23. Fret | |
| 13. Groove | 24. Strings | |

DETAILED DESCRIPTION OF THE INVENTION

Physical Attributes of a Typical Embodiment

The slide-guitar capo presented herein consists of an essentially prismatic bar (triangular in cross section, FIG. 1) at least 6 cm long and made of relatively hard, dense, smooth and resilient material (plastic or metal). The three side faces differ in width (FIG. 1), such that, with the widest face as base (12), the ridge (11) is about 10 mm high, with the narrowest face as base, the ridge is about 13 mm high, and, with the other face as base, the ridge is about 11.2–11.5 mm high (FIGS. 1 and 3). Greater or lesser ridge heights than these may be desirable for some applications. A straight groove (13), about 1.2 mm deep and about 3.5 mm wide (or wider), extends the full length of each face (FIGS. 1 and 2), paralleling the bar's long axis and under the ridge (11) when that face is base (12). The groove on each face is slightly displaced toward the midline of that face. The side edges are rounded down about 0.2 mm, and the end edges and end corners are rounded down further. All surfaces are smooth (though this is imperfectly represented in the drawings).

Operation of Invention

Most acoustic slide guitars have physical frets (23) comparable to those of Spanish guitars. Others have fret markings only. The strings (24) of virtually all dedicated slide guitars are about 1 cm above the fretboard (22). After deciding which of the three orientations of the slide-guitar capo described herein (10) is appropriate for the fret position of interest, one slips the capo under the strings from either side of the guitar's neck with the groove (13) in its base over a fret or fret marking (FIGS. 3 and 4). Owing to the rounded end corners, the strings are lifted gently to ridge height by cam action as the capo slides under them. When the capo is to be over either of the first two frets (nearest the nut (21)), a lesser (probably the least) ridge height is selected (FIG. 3A). When the capo is to be over a fret near the middle of the guitar's neck, a greater (probably the greatest) ridge height is selected (FIG. 3C). When the capo is to be over frets between these extremes, the middle ridge height may be selected (FIG. 3B). But at any fret position, the choice of capo orientation (ridge height) depends on playing style and preference. The user has discretion. Moreover, the nut and bridge of one slide guitar will suspend the strings at heights above the fretboard differing from those of another slide guitar, requiring different choices among the capo's ridge heights for different slide guitars.

In order to serve its purpose of stopping the strings near a desired fret, this kind of capo must exert upward force on the strings, displacing them upward. This increases string tensions, with the result that all pitches would be higher than desired (sharp) if the ridge were centered over the fret. The groove in the base is wide enough to allow the ridge to be placed above the back edge of the fret (the edge nearest the nut) or even a little closer to the nut to achieve compensatory pitch reduction. A comparable adjustment is made in placement of the slide bar during performance. The groove on each face of the capo is not exactly centered under the ridge when that face is base; the groove is displaced somewhat towards the midline of that face, to increase the range of this compensatory adjustment with little loss of that face's surface area.

The harder the strings are plucked, the greater must be the force between the capo's ridge and the guitar's strings to avoid buzzing. This is not a problem with the capo at one of the first three frets near the nut. With the capo at higher frets, it need not be a problem; but it can be prevented by use of a thin but stiff padded rod (30) across the strings about 2–3 inches toward the nut from the capo, this padded rod pressing gently down on the strings either by action of an elastic strap looped under the guitar's neck as illustrated in FIG. 3C (analogous to Gould U.S. Pat. No. 4,304,165; Russell U.S. Pat.No. 1,788,636), or by action of a spring on each end of the padded rod, each spring being connected to the corresponding end of another padded rod placed under the neck (analogous to Cornette U.S. Pat. No. 4,621,558, commercial make Three CC Glider, but with longer springs and with both pads being cylindrical rather than longitudinally concave or hour-glass shaped). This accessory device, being inches toward the nut from the capo and from the operational string segments, would not interfere with operation of the slide bar at positions near the capo (or elsewhere).

Conclusion, Ramifications and Scope of Invention

The slide-guitar capo presented herein is easier to apply than patented or commercially available slide-guitar capos, including that of Ellis (U.S. Pat. No. 5,284,077); for it has no joints or clamps. Like the Ellis dobro capo it accomplishes essentially what earlier or existing dobro capos accomplish without any element above the strings near the capo and playing segments of the strings (between capo and bridge), allowing the musician to use the slide bar on the strings at the frets nearest the capo (and all other operative frets) with no obstruction. By contrast to its commercial and patented counterparts, including that of Ellis, it consists of only one solid bar, rather than 6 or more parts, so its manufacture should be less expensive. Also, its three ridge heights allow a more nearly optimal capo action at a variety of fret positions and with a variety of slide-guitar makes than can be achieved with any other slide-guitar capo including that of Ellis.

I claim:

1. A slide-guitar capo, comprising: a prismatic bar comprised of metal or plastic, having a length of at least 6 cm, and having three side faces, each side face of said prismatic bar having a different width and each intersection between adjacent side faces having a different angle such that said prismatic bar further comprises three ridges, with heights between 10 and 13 mm depending on which side face of said prismatic bar is the base upon which it rests, each said side face having a longitudinal groove at least 3.5 mm in width and at least 1.2 mm in depth from the surface of said side face, the edges and corners at intersections of adjacent faces of said prismatic bar being rounded down at least 0.2 mm from said intersections.

2. A slide-guitar capo described in claim 1, wherein said slide-guitar capo further comprises means to press the guitar's strings toward the guitar's fretboard at a zone between the guitar's nut and said slide-guitar capo.

* * * * *